United States Patent [19]

Mercer et al.

[11] Patent Number: 5,056,738

[45] Date of Patent: Oct. 15, 1991

[54] DAMPER ASSEMBLY FOR A STRUT IN A JET PROPULSION ENGINE

[75] Inventors: Gary D. Mercer, Palm Beach, Fla.; Kurt T. Hildebrand, Mariemont, Ohio

[73] Assignee: General Electric Company, Cincinnati, Ohio

[21] Appl. No.: 404,018

[22] Filed: Sep. 7, 1989

[51] Int. Cl.[5] ..... B64B 27/00

[52] U.S. Cl. ..... 244/54; 416/233; 416/500; 415/119; 248/554

[58] Field of Search ..... 244/54, 55; 416/500, 416/233; 415/119; 248/554, 557

[56] References Cited

U.S. PATENT DOCUMENTS

| | | | |
|---|---|---|---|
| 2,642,263 | 6/1953 | Thorp, II | 416/233 |
| 2,689,107 | 9/1954 | Odegaard | 416/233 |
| 3,566,493 | 3/1971 | Poacher et al. | 416/233 |
| 3,814,549 | 6/1974 | Cronstedt | 415/119 |
| 3,936,920 | 2/1976 | Conn, Jr. | 416/233 |
| 4,044,973 | 8/1977 | Moorehead | 244/54 |
| 4,307,857 | 12/1981 | Godbersen | 244/54 |
| 4,361,296 | 11/1982 | Hall et al. | 244/54 |
| 4,544,115 | 10/1985 | Edgley | 244/54 |

FOREIGN PATENT DOCUMENTS

| | | | |
|---|---|---|---|
| 0028970 | 5/1981 | France | 244/54 |
| 574770 | 1/1946 | United Kingdom . | |
| 893787 | 3/1962 | United Kingdom . | |
| 909004 | 11/1962 | United Kingdom . | |
| 1345835 | 2/1974 | United Kingdom . | |
| 2071775 | 9/1981 | United Kingdom . | |
| 2154286 | 9/1985 | United Kingdom . | |
| 2154287 | 9/1985 | United Kingdom . | |

*Primary Examiner*—Joseph F. Peters, Jr.
*Assistant Examiner*—Christopher P. Ellis
*Attorney, Agent, or Firm*—Jerome C. Squillaro

[57] ABSTRACT

The present invention is a damper assembly included in a strut on the front frame for a jet propulsion engine. The damper assembly is disposed within the strut for damping vibration of the strut as a result of air stream pressure pulses from first stage fan blades causing strut excitation when the fan blades are operating at least at transonic speeds.

27 Claims, 1 Drawing Sheet

DAMPER ASSEMBLY FOR A STRUT IN A JET PROPULSION ENGINE

The Government has rights in the invention pursuant to Contract No. F33657-84-C-0264 awarded by the Department of the Air Force.

BACKGROUND OF THE INVENTION

1. Field of the Invention

The present invention relates generally to hollow struts in jet propulsion engines, and more particularly, to a damper assembly for a strut in a jet propulsion engine.

2. Description of Related Art

Jet propulsion engines include a family of engines known as "transonic" jet propulsion engines. These transonic jet propulsion engines may be of a turbofan type capable of operating at transonic or supersonic speeds. The transonic jet propulsion engines typically include a front frame, the upstream end of which forms an inlet sized to provide a predetermined airflow, and a fan directly behind the front frame for pressurizing an inlet airflow. Downstream of the fan is a core engine for combusting fuel mixed with the pressurized air to produce combustion gases which are discharged to obtain a propulsive force for the engine.

The front frame typically includes a cast outer cylindrical case or shroud, an inner circumferential support or hub ring, and a plurality of circumferentially spaced apart and radially outwardly extending fixed struts disposed between the outer cylindrical case and the inner circumferential hub ring. An internal strut stiffener is generally disposed between the walls of the strut to resist buckling of the strut walls.

The fan typically includes a fan rotor which rotates a plurality of blade assemblies in at least one or more rows or stages. During assembly or operation of the fan, physical variations may exist in or between the blade assemblies. For example, variations may exist as to the spacing of the blade assemblies circumferentially about the rotor or as to the leading edges of the blade assemblies, e.g. nicked or blunt.

When the fan blades are operated at transonic or supersonic speeds, these physical variations in the first stage blade assemblies of the fan will produce air stream pressure pulses or fluctuations known as "multiple pure tones". These multiple pure tones travel forward and excite the strut or vibrate the strut at its natural frequencies. This occurs over a broad range of frequencies.

One disadvantage of the above arrangement is that high cycle fatigue may cause cracking of the struts. The cracking occurs as a result of excitation of underdamped first flexural and torsional strut natural frequencies due to the multiple pure tones. Another disadvantage is costly repair of the struts due to cracking. One advantage that the present invention provides is a cost effective repair.

SUMMARY OF THE INVENTION

It is therefore a primary object of the present invention to provide a strut in which a damper assembly is installed to produce sufficient damping to dissipate the energy in the strut caused by the multiple pure tone excitation.

It is also an object of the present invention to provide a damper assembly which reduces strut vibration and cracking as a result of multiple pure tones.

It is a further object of the present invention to increase the damping of the strut for the first and second flexural and torsional natural frequencies.

It is yet a further object of the present invention to provide damping as a retrofit for the strut and increases service life of the front frame.

Briefly stated, the above objects are accomplished in the preferred embodiment of the present invention wherein a unique damper assembly is included in a strut on the front frame for a jet propulsion engine. The damper assembly is disposed within the strut for damping vibration of the strut as a result of air stream pressure pulses causing strut excitation when the jet propulsion engine's fan is operating at least at or above sonic speeds.

Accordingly, the present invention produces sufficient damping to dissipate energy caused by strut excitation due to multiple pure tones. The present invention provides relative motion between a damper and the strut walls. The present invention also provides a normal force for coulomb damping which occurs at the interface of the strut and damper assembly to dissipate energy and reduce strut cracking. Further, the damper of the present invention provides viscoelastic damping when exposed to the shear stress caused during flexure or bending. Still further, the present invention increases damping of the strut for the first and second flexural and torsional natural frequencies.

Other objects, features and advantages of the present invention will be readily appreciated as the same becomes better understood by reference to the following description when considered in connection with the accompanying drawings.

DESCRIPTION OF THE PREFERRED EMBODIMENT

Figure 1:
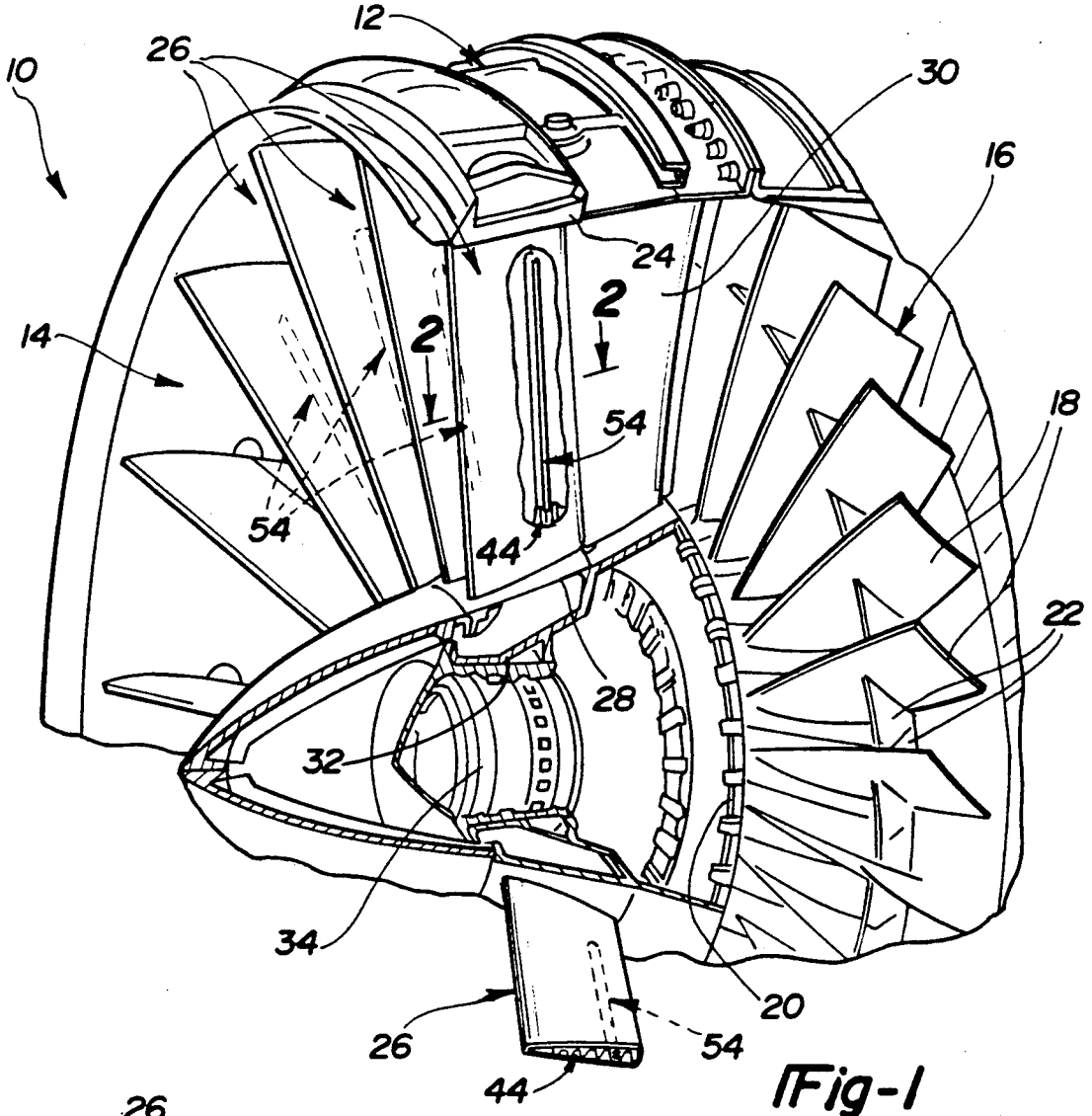
FIG. 1 is a partial perspective view of a front frame and fan of a jet propulsion engine having struts incorporating a damper assembly according to the present invention.

Referring to the drawings, wherein like numerals correspond to like elements throughout, attention is first directed to FIG. 1. In FIG. 1, there is partially shown a jet propulsion engine 10, such as a turbofan jet propulsion engine. It should be appreciated that the jet propulsion engine 10 includes fan blades, generally shown at 16, which may be of a suitable type capable of operating at transonic or supersonic speeds.

The jet propulsion engine 10 includes a front frame, generally indicated at 12, the upstream end of which forms an inlet 14 sized to provide a predetermined airflow. The jet propulsion engine 10 includes a fan, generally indicated at 16, downstream of the front frame 12. The fan 16 pressurizes the airflow from the inlet 14, at least a portion of which is delivered downstream to a core engine (not shown). Aft of the core engine, typically, there is a fan turbine (not shown) which interconnects the fan 16 by means such as a shaft (not shown). The core engine includes an axial flow compressor (not shown) which compresses or pressurizes the air exiting the fan which is then discharged to a combustor (not shown). In the combustor, fuel is burned to provide high energy combustion gases which drive a turbine (not shown) which, in turn, drives the compressor. The gases of combustion then pass to and drive the fan turbine which, in turn, drives the fan. A more detailed description of the jet propulsion engine 10 is disclosed in either U.S. Pat. No. 3,879,941—Sargisson or U.S. Pat. No. 4,080,785—Koff et al, both of which are assigned to the same assignee as the present invention, and the disclosed material of both patents is incorporated herein by reference.

The fan 16 includes a first or forward fan stage including a plurality of rotor blade assemblies 18 which are circumferentially spaced apart about a fan rotor 20. Each forward rotor blade assembly 18 includes a part span shroud 22 extending beyond the full cord of the blade, in abutting relation with the part span shrouds 22 of adjacent blade assemblies 18. It should be appreciated that the fan 16 may include a plurality of rows or stages of rotor blade assemblies 18.

The front frame 12 is positioned directly in front or upstream of the fan rotor 20. The front frame 12 includes a cast outer cylindrical case or shroud 24 which forms the inlet 14. The front frame 12 includes a plurality of circumferentially spaced apart struts, generally indicated at 26, extending radially outwardly from an inner circumferential support or hub ring 28 to the outer cylindrical case 24. Each strut 26 may include a variable angle trailing edge flap or inlet guide vane 30 positioned directly behind or downstream each strut 26. The inner circumferential hub ring 28 includes an inwardly and forwardly extending conical extension 32 for supporting a forward fan shaft bearing 34. It should be appreciated that the struts 26 are fixed relative to the outer cylindrical case 24 and inner circumferential hub ring 28.

Figure 2:
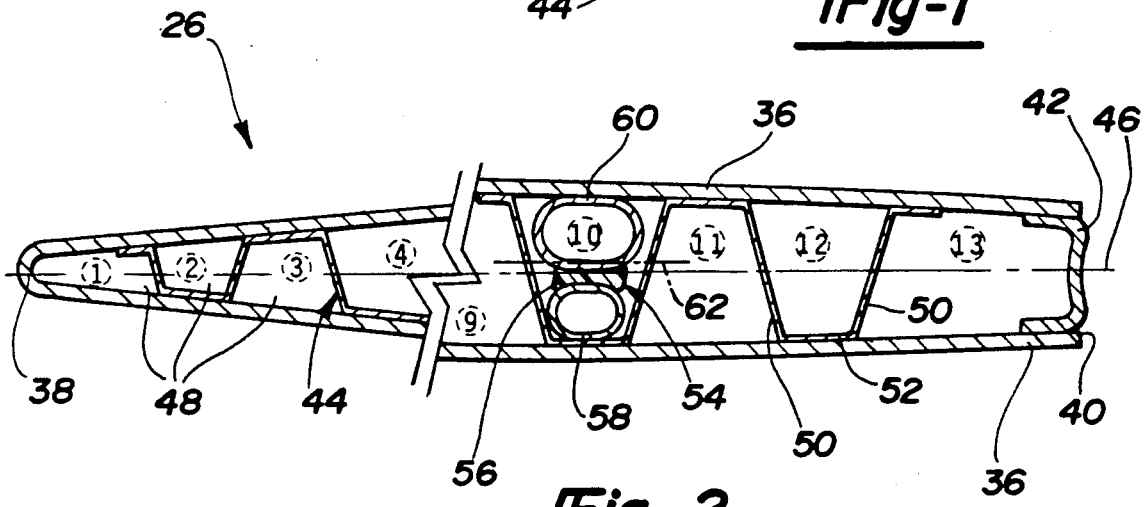
FIG. 2 is a cross-sectional view of the damper assembly installed in the strut taken along line 2—2 of FIG. 1.

Referring to FIGS. 1 and 2, the strut 26 includes a pair of strut walls 36 which extend from a continuous generally arcuate leading edge 38 to an open trailing edge 40. The strut 26 includes a generally U-shaped end or support member 42 disposed between the strut walls 36 and closing the trailing edge 40. The support member 42 is secured to the strut walls 36 by means such as brazing. An internal strut stiffener, generally indicated at 44, is disposed between the strut walls 36 from the leading edge 38 to the trailing edge 40 of the strut 26 and extends radially along the strut walls 36. The internal strut stiffener 44 has a shape similar to a honeycomb or square wave. The internal strut stiffener 44 extends along a strut neutral axis 46 of the strut 26 extending between the leading and trailing edges 38 and 40, respectively. The internal strut stiffener 44 divides the hollow interior of the strut 26 into a plurality of cells 48. As shown in FIG. 2, each cell 48 is indicated by a reference number inside a dotted circle, beginning with the cell 48 near the leading edge 38 and consecutively numbered for thirteen cells which end near the trailing edge 40. Each cell 48 of the internal strut stiffener 44 is formed by generally inclined vertical walls 50 on each end of a horizontal wall 52. The horizontal wall 52 is shaped to follow the contour of the inside surface of the strut walls 36 and is secured to the strut walls 36 by means such as brazing.

Referring again to FIGS. 1 and 2, a strut 26 incorporating a damper assembly, generally indicated at 54, according to the present invention is shown. The damper assembly 54 includes a damper 56 configured as a plate member sandwiched between a first friction liner 58 and a second friction liner 60. The first and second friction liners 58 and 60 are generally toriodally shaped and abut the surfaces of the strut walls 36 and horizontal wall 52 of the internal strut stiffener 44. The first friction liner 58 is made from a substantially inelastic material having a wall thickness of 0.012 inches and a major outside diameter of 0.156 inches. The damper 56 is made from an elastomeric material and has a thickness of approximately 0.050 inches. The second friction liner 60 is made from a substantially inelastic material having a wall thickness of 0.016 inches and a major outside diameter of 0.218 inches. It should be appreciated that other suitable diameters and wall thickness of the materials may be used.

As shown in FIGS. 1 and 2, the damper assembly 54 is disposed in the strut 26 in the cell 48 having a reference number ten (10). The damper assembly 54 extends radially along the strut 26 and is orientated such that the damper 56 is offset between a damper neutral axis 62 of itself and the strut neutral axis 46 to provide relative motion between the damper assembly 54 and strut walls 36. It should be noted that damper neutral axis 62 may be located either above or below strut neutral axis 46. It should be appreciated that the damper assembly 54 is disposed in an area of large deflection of the strut walls 36 and may extend only partially radially along the length of the strut 26. It should also be appreciated that the damper assembly 54 may be located in a cell 48 having a different reference number. It should further be appreciated that more than one damper assembly 54 may be used. It should still further be appreciated that the damper assembly 54 may be used with any suitable strut stiffener.

In operation, multiple pure tones may be produced by physical variations in the first stage blade assemblies 18 when the fan blades are operating at transonic or supersonic speeds. The multiple pure tones travel forward to excite or vibrate the struts 26. This produces bending or flexural and/or torsional movement of the strut walls 36. The damper 56 flexes as a result of the movement to cause at least a portion of the friction liners 58 and 60 to contact rub along the strut walls 36. As a result, the friction liners 58 and 60 absorb and dissipate the energy caused by strut excitation.

Accordingly, the damper assembly 54 allows coulomb damping to occur to dissipate the energy at the interface of the damper assembly 54 and strut walls 36. The damping assembly 54 significantly increases damping of the strut 26 for the first and second flexural or bending and torsional natural frequencies. The elastomeric material of the damper 56 provides a normal force for coulomb damping in addition to viscoelastic damping when exposed to the shear stress caused during bending or flexure of the damper 56 due to strut excitation caused by the multiple pure tones.

The present invention has been described in an illustrative manner. It is to be understood that the terminology which has been used is intended to be in the nature of words of description rather than of limitation.

Obviously, many modifications and variations of the present invention are possible in light of the above teachings. For example the present invention can be applied to any static hollow airfoil, which include struts or vanes, that is upstream of a rotating blade. One such embodiment may be a hollow inlet guide vane in front of an aft mounted fan, another is a hollow vane in front of a compressor blade. It is, therefore, to be understood that within the scope of the appended claims, the present invention may be practiced otherwise than as specifically described.

What is claimed is:

1. A strut assembly for a jet propulsion engine having a front frame forming an inlet and fan blades disposed downstream of the front frame, the strut assembly extending radially between an outer cylindrical case and an inner circumferential hub ring of the front frame, said strut assembly comprising:

at least one front frame strut and damping means disposed within said strut capable of coulomb damping and viscoelastic damping vibration of said strut as a result of air stream pressure pulses from the fan exciting said strut when the fan blades are operating at least at transonic speeds.

2. A strut assembly for a jet propulsion engine having a front frame forming an inlet and fan blades disposed downstream of the front frame, the strut assembly extending radially between an outer cylindrical case and an inner circumferential hub ring of the front frame, said strut assembly comprising:

means disposed within said strut for damping vibration of the strut as a result of air stream pressure pulses from the fan exciting the strut when the fan blades are operating at least at transonic speeds, wherein said damping means comprises a pair of spaced friction liners disposed between and extending radially along a pair of walls of the strut, and a damper disposed between and extending radially along said pair of spaced friction liners.

3. A strut assembly as set forth in claim 2 wherein said damper is a rectangular plate member.

4. A strut assembly as set forth in claim 2 wherein said damper is made of an elastomeric material.

5. A strut assembly as set forth in claim 2 wherein said friction liners are toroidally shaped.

6. A strut assembly as set forth in claim 5 wherein one of said pair of spaced friction liners has a major diameter greater than a major diameter of the other of said pair of spaced friction liners.

7. A strut assembly as set forth in claim 2 wherein said pair of spaced friction liners are made of a substantially inelastic material.

8. A damper assembly for use in a strut on a jet propulsion engine, the strut including a pair of spaced walls extending between a leading edge and a trailing edge and a strut stiffener disposed between said walls and forming a plurality of cells, said damper assembly comprising:

a pair of spaced friction liners disposed within at least one of the cells; and means forming a damper disposed between said pair of spaced friction liners for flexing to contact a portion of said pair of spaced friction liners with at least one of said sidewalls to dampen excitation of the strut.

9. The damper assembly as set forth in claim 8 wherein said damper means comprises a damper made of an elastomeric material.

10. The damper assembly as set forth in claim 9 wherein said pair of spaced friction liners are made of a substantially inelastic material.

11. The damper assembly as set forth in claim 10 wherein said pair of spaced friction liners are toroidally shaped.

12. The damper assembly as set forth in claim 11 wherein one of said pair of spaced friction liners has a major diameter greater than a major diameter of the other of said pair of spaced friction liners.

13. The damper assembly as set forth in claim 12 wherein said damper is shaped as a plate member.

14. A strut assembly for a jet propulsion engine including a front frame forming an inlet for an inlet airflow and a fan disposed downstream of the front frame to pressurize the inlet airflow, the fan having a rotor and a plurality of blade assemblies circumferentially disposed about the rotor, and the front frame having an outer cylindrical case and an inner circumferential hub ring radially spaced from the outer cylindrical case, the strut assembly extending radially between the outer cylindrical case and the inner circumferential hub ring, said strut assembly comprising:

a front frame strut including a pair of spaced walls extending between a leading edge and a trailing edge;

a strut stiffener disposed between said walls and said leading and trailing edges to form a plurality of cells; and damping means disposed within at least one of said cells capable of coulomb damping and viscoelastic damping vibration of said strut as a result of pressure pulses from the blade assemblies causing excitation of said strut when the fan blades are operating at least at transonic speeds.

15. A strut assembly for a jet propulsion engine including a front frame forming an inlet for an inlet airflow and a fan disposed downstream of the front frame to pressurize the inlet airflow, the fan having a rotor and a plurality of blade assemblies circumferentially disposed about the rotor, and the front frame having an outer cylindrical case and an inner circumferential hub ring radially spaced from the outer cylindrical case, the strut assembly extending radially between the outer cylindrical case and the inner circumferential hub ring, said strut assembly comprising:

a pair of spaced walls extending between a leading edge and a trailing edge;

a strut stiffener disposed between said walls and said leading and trailing edges to form a plurality of cells; and means disposed within at least one of said cells for damping vibration of said strut as a result of pressure pulses from the blade assemblies causing excitation of said strut when the fan blades are operating at least at transonic speeds, wherein said damping means comprises first and second friction liners and a damper disposed between said friction liners.

16. A strut assembly as set forth in claim 15 wherein said damper is made of an elastomeric material.

17. A strut assembly as set forth in claim 16 wherein said first and second friction liners are made of a substantially inelastic material.

18. A strut assembly as set forth in claim 17 wherein said first and second friction liners are toroidally shaped.

19. A strut assembly as set forth in claim 18 wherein said second friction liner has a major diameter greater than a major diameter of said first friction liner.

20. A strut assembly as set forth in claim 19 wherein said damper is shaped as a plate member.

21. A static airfoil assembly for a gas turbine engine disposed upstream of rotating blades, said assembly comprising:

a radially disposed hollow airfoil and damping means disposed within said airfoil capable of coulomb damping and viscoelastic damping vibration of the airfoil as a result of air stream pressure pulses from the fan exciting said airfoil when the fan blades are operating at least at transonic speeds.

22. An airfoil assembly as set forth in claim 21 wherein said damping means comprises a pair of spaced friction liners disposed between and extending radially along a pair of walls of the airfoil, and a damper disposed- between and extending radially along said pair of spaced friction liners.

23. An airfoil assembly as set forth in claim 22 wherein said damper is a rectangular plate member.

24. An airfoil assembly as set forth in claim 22 wherein said damper is made of an elastomeric material.

25. An airfoil assembly as set forth in claim 23 wherein said friction liners are toroidally shaped.

26. A static airfoil assembly for a gas turbine engine disposed upstream of rotating blades, said assembly comprising:

a hollow airfoil, means disposed within said airfoil for damping vibration of the airfoil as a result of air stream pressure pulses from the fan exciting the airfoil when the fan blades are operating at least at transonic speeds, wherein said damping means comprises a pair of spaced friction liners disposed between and extending radially along a pair of walls of the airfoil, and a rectangular plate damper disposed between and extending radially along said pair of spaced toroidally shaped friction liners, and wherein one of said pair of spaced friction liners has a major diameter greater than a major diameter of the other of said pair of spaced friction liners.

27. An airfoil assembly as set forth in claim 25 wherein said pair of spaced friction liners are made of a substantially inelastic material.

* * * * *